US007631685B2

(12) United States Patent
Ondrovic et al.

(10) Patent No.: US 7,631,685 B2
(45) Date of Patent: Dec. 15, 2009

(54) PINCH ROLL APPARATUS AND METHOD FOR OPERATING THE SAME

(75) Inventors: Jay Jon Ondrovic, Brownsburg, IN (US); Richard Britanik, Sarver, PA (US); Tino Domanti, Coal Point (AU); Glen Wallace, Whitebridge (AU)

(73) Assignee: Nucor Corporation, Charlotte, NC (US)

( * ) Notice: Subject to any disclaimer, the term of this patent is extended or adjusted under 35 U.S.C. 154(b) by 524 days.

(21) Appl. No.: 11/465,276

(22) Filed: Aug. 17, 2006

(65) Prior Publication Data

US 2006/0283571 A1 Dec. 21, 2006

Related U.S. Application Data

(62) Division of application No. 11/085,727, filed on Mar. 21, 2005, now Pat. No. 7,163,047.

(51) Int. Cl.
*B22D 11/06* (2006.01)
*B22D 11/128* (2006.01)

(52) U.S. Cl. ..... 164/428; 164/442

(58) Field of Classification Search ..... 164/428, 164/442, 448

See application file for complete search history.

(56) References Cited

U.S. PATENT DOCUMENTS 4,700,312 A 10/1987 Kikuma et al.
4,940,076 A 7/1990 Desautels et al.
5,626,183 A 5/1997 Romanowski et al.
5,636,543 A 6/1997 Kajiwara et al.
5,950,476 A 9/1999 Brashear
6,129,136 A 10/2000 Tibbs et al.
6,301,946 B1 10/2001 Kukizaki et al.
6,766,934 B2 7/2004 Ziegelaar et al.
7,163,047 B2 * 1/2007 Ondrovic et al. ..... 164/484

FOREIGN PATENT DOCUMENTS

DE 4208490 9/1993

(Continued)

OTHER PUBLICATIONS

International Search Report for PCT/AU2006/00272.

(Continued)

*Primary Examiner*—Kevin P Kerns
(74) *Attorney, Agent, or Firm*—Hahn Loeser & Parks LLP; Arland T. Stein

(57) ABSTRACT

Pinch roll apparatus has a pair of pinch rolls, each having a diameter between 300-1500 millimeters, positioned to form a nip through which metal strip can be continuously fed. The pinch rolls are positioned one above the other with the axes of the pinch rolls offset in the direction of travel of the strip, with the upper pinch roll offset positioned between 10 and 130 mm downstream of the direction of travel of the strip through the pinch rolls. A rotational drive counter-rotates the pinch rolls to cause strip to pass through the nip of the pinch rolls. A tilt drive tilts the upper pinch roll by a tilt between 0.5 and 5.0 mm to control steering of the strip passing through the pinch rolls. The steering of the tilt drive may be automatically controlled through a controller actuated by a sensor.

12 Claims, 6 Drawing Sheets

FOREIGN PATENT DOCUMENTS

| | | | |
|---|---|---|---|
| EP | 0-726-112 | | 8/1996 |
| EP | 0-903-187 | | 3/1999 |
| JP | 01-148412 | | 6/1989 |
| JP | 63-207888 | | 2/1990 |
| JP | 05-138249 | | 6/1993 |
| JP | 07-116724 | | 5/1995 |
| JP | 07-256327 | | 10/1995 |
| JP | 08-090063 | | 4/1996 |
| JP | 8-206790 | * | 8/1996 |
| JP | 08-206790 | | 8/1996 |
| JP | 08-215814 | | 8/1996 |
| JP | 10-005808 | | 1/1998 |
| JP | 11-347616 | | 12/1999 |
| JP | 2000-263120 | | 9/2000 |
| JP | 2001-220642 | | 8/2001 |
| JP | 2001-246401 | | 9/2001 |
| JP | 2002-336909 | | 11/2002 |
| JP | 2003-154441 | | 5/2003 |
| WO | 92/01524 | | 2/1992 |

OTHER PUBLICATIONS

Written Opinion for PCT/AU2006/00272.

English translation of Japanese Patent Publication No. 8-206790, "Method and Apparatus for Correcting Meandering of Thin Cast Slab," Nippon Steel Corporation et al., Aug. 13, 1996 (11 pages).

* cited by examiner

PINCH ROLL APPARATUS AND METHOD FOR OPERATING THE SAME

This application is a division of application Ser. No. 11/085,727, filed Mar. 21, 2005, which issued as U.S. Pat. No. 7,163,047 on Jan. 16, 2007.

BACKGROUND AND SUMMARY OF THE INVENTION

This invention relates to pinch rolls and particularly to those used in continuous casting of thin steel strip in a twin-roll caster.

In a twin roll caster, molten metal is introduced between a pair of counter-rotated horizontal casting rolls that are cooled so that metal shells solidify on the moving roll surfaces, and are brought together at the nip between them to produce a solidified strip product delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip to form a casting pool of molten metal supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

When casting steel strip in a twin roll caster, the strip leaves the nip at very high temperatures on the order of 1400° C. or higher. If exposed to normal atmosphere, it would suffer very rapid scaling due to oxidation at such high temperatures. Therefore, a sealed enclosure is provided beneath the casting rolls to receive the hot strip and through which the strip passes away from the strip caster, the enclosure containing an atmosphere that inhibits oxidation of the strip. The oxidation inhibiting atmosphere may be created by injecting a non-oxidizing gas, for example, an inert gas such as argon or nitrogen, or combustion exhaust gases which may be reducing gases. Alternatively, the enclosure may be sealed against ingress of oxygen containing atmosphere during operation of the strip caster. The oxygen content of the atmosphere within the enclosure is then reduced during an initial phase of casting by allowing oxidation of the strip to extract oxygen from the sealed enclosure as disclosed in U.S. Pat. Nos. 5,762,126 and 5,960,855.

It is generally understood in the past that to produce thin cast strip the strip was guided by pinch rolls. These pinch rolls are positioned at the exit of the enclosure containing the oxygen depleted atmosphere through which the strip passes following formation at the casting rolls. A problem occurs however in steering the cast strip through the pinch rolls at casting speeds. The pinch rolls have a crown that varies with thermal expansion of the rolls, and reduces contact between the surfaces of the pinch rolls and the strip. The strip tends to wander, which can cause difficulties in processing of the strip downstream of the caster and, in some circumstances, breakage of the strip and shutdown of the casting operation. Also, there can be localized deformation and tearing of the strip. This steering problem is caused by a lack of contact of the pinch rolls with the strip across its width as illustrated in FIG. 1.

Accordingly, there has been a need for pinch rolls that better control the steering of the strip within close tolerances to improve the processing capabilities of the cast strip plant, and at the same time, provide steering of the strip by the pinch rolls that can be automatically controlled with improved accuracy. The resulting pinch rolls apparatus of the present invention solves this problem in continuous casting of thin cast strip and in apparatus that is also useful in other applications. By reason of the geometry of the apparatus, there is no path for the strip through the pinch rolls where the strip can pass without maintaining contact of the strip across its width with surfaces of the pinch rolls, and at the same time steering the strip accurately and stabilizing the lateral movement of the strip relative to the pinch rolls.

The present invention is a pinch roll apparatus comprising:

a. upper and lower pinch rolls forming a pair of pinch rolls each having a diameter between 300-1500 mm positioned laterally adjacent each other to form a nip between them through which metal strip can be continuously fed;

b said upper and lower pinch rolls being positioned one above the other with the axes of the pinch rolls offset in the direction of travel of strip through the pinch rolls by between 10 and 130 mm, and with the upper pinch roll offset positioned downstream of the direction of travel of the strip through the pinch rolls;

c. a rotational drive capable of counter-rotating the pinch rolls to cause strip to pass through the nip of the pinch rolls; and d. a tilt drive capable of tilting the upper pinch roll by a tilt between 0.5 and 5.0 mm, measured at the edge of the strip, relative to the lower pinch roll to control steering of the strip passing through the pinch rolls.

The pinch roll diameter may be between 500 and 1000 mm, and the offset of the axes of the pinch rolls may be between 30 and 80 mm.

The pinch roll apparatus also may comprise:

e. a sensor capable of sensing the position of the strip relative to pinch rolls and generating electrical signals indicating the position of the strip relative to the pinch rolls; and f. a position controller actuated by said electrical signals from the sensor capable of actuating the drive to tilt the upper pinch roll relative to the lower pinch roll and automatically steer the strip passing through the pinch rolls.

Alternative, the pinch roll apparatus may comprise:

a. upper and lower pinch rolls forming a pair of pinch rolls positioned laterally adjacent each other to form a nip between them through which metal strip can be continuously fed;

b. said upper and lower pinch rolls being positioned one above the other with the axes of the pinch rolls offset in the direction of travel of strip through the pinch rolls, and with the upper pinch roll offset positioned downstream of the direction of travel of the strip through the pinch rolls;

c. a rotational drive capable of counter-rotating the pinch rolls to cause strip to pass through the nip of the pinch rolls; and d. a tilt drive capable of tilting the upper pinch roll by an angle relative to lower pinch roll to control steering of the strip passing through the pinch rolls;

selected such that:

$$(R_{upper\ min}+h_{min}+R_{lower\ min}-|\mathrm{Tilt}_{os\text{-}ds}|)/(R_{upper\ max}+h_{max}+R_{lower\ max})>\cos(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness taking into consideration profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$Tilt_{os\text{-}ds}$ is tilt of the axis of the upper pinch roll relative to the lower pinch roll measured vertically between the edges of the strip; and θ is angle from vertical of the line between the axis of the upper and the lower pinch rolls.

Again, the pinch roll apparatus may further comprise:

e. a sensor capable of sensing the position of the strip relative to pinch rolls and generating electrical signals indicating the position of the strip relative to the pinch rolls; and f. a position controller actuated by said electrical signals from the sensor capable of actuating the tilt drive to tilt the upper pinch roll relative to the lower pinch roll and automatically steer the strip passing through the pinch rolls.

Alternatively or in addition, a thin cast strip plant for producing strip by continuous casting is provided comprising:

a. a thin strip caster having a pair of casting rolls having a nip there between;

b. a metal delivery system capable of forming a casting pool between the casting rolls above the nip with side dams adjacent the ends of the nip to confine said casting pool;

c. a casting roll drive capable of counter-rotating the casting rolls to form metal shells on surfaces of the casting rolls, and cast strip delivered downwardly from the nip between the casting rolls;

d. upper and lower pinch rolls forming a pair of pinch rolls, each having a diameter between 300-1500 mm, positioned laterally adjacent each other to form a nip between them through which metal strip formed by the caster can pass;

e. said upper and lower pinch rolls being positioned one above the other with the axes of the pinch rolls offset in the direction of travel of strip through the pinch rolls by between 10 and 130 mm, and with the upper pinch roll offset positioned downstream of the direction of travel of the strip through the pinch rolls;

f. a pinch roll rotational drive capable of counter-rotating the pinch rolls to cause strip to pass through the nip of the pinch rolls; and g. a pinch roll tilt drive capable of tilting the upper pinch roll by a tilt between 0.5 and 5.0 mm, measured at the edge of the strip, relative to lower pinch roll to control steering of the strip passing through the pinch rolls.

The pinch roll diameter in the thin cast strip plant may be between 500 and 1000 mm, and the offset of the axes of the pinch rolls may be between 30 and 80 mm.

The thin cast strip plant for producing strip by continuous casting also may further comprise:

h. a sensor capable of sensing the position of the strip relative to pinch rolls and generating electrical signals indicating the position of the strip relative to the pinch rolls; and i. a position controller actuated by said electrical signals from the sensor capable of actuating the pinch roll tilt drive to tilt the upper pinch relative to the lower pinch roll and automatically steer the strip passing through the pinch rolls.

Alternatively, the thin cast strip plant for producing strip by continuous casting may comprise:

a. a thin strip caster having a pair of casting rolls having a nip there between;

b. a metal delivery system capable of forming a casting pool between the casting rolls above the nip with side dams adjacent the ends of the nip to confine said casting pool;

c. a casting roll drive capable of counter-rotating the casting rolls to form metal shells on surfaces of the casting rolls, and to cast strip from the shells delivered downwardly from the nip between the casting rolls;

d. upper and lower pinch rolls forming a pair of pinch rolls positioned laterally adjacent each other to form a nip between them through which metal strip formed by the caster can pass;

e. said upper and lower pinch rolls being positioned one above the other with the axes of the pinch rolls offset in the direction of travel of strip through the pinch rolls, and with the upper pinch roll offset positioned downstream of the direction of travel of the strip through the pinch rolls;

f. a pinch roll rotational drive capable of counter-rotating the pinch rolls to cause strip to pass through the nip of the pinch rolls; and g. a pinch roll tilt drive capable of tilting the upper pinch roll relative to lower pinch roll to control steering of the strip passing through the pinch rolls;

selected such that:

$$(R_{upper\ min}+h_{min}+R_{lower\ min}-|Tilt_{os\text{-}ds}|)/(R_{upper\ max}+h_{max}+R_{lower\ max})>\cos(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness considering strip profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$Tilt_{os\text{-}ds}$ is the tilt of the axis of the upper pinch roll relative to the axis of the lower pinch roll measured vertically between edges of the strip; and θ is angle from vertical of a line between the axis of the upper and the lower pinch rolls.

The thin cast strip plant for producing strip by continuous casting may further comprise:

h. a sensor capable of sensing the position of the strip relative to pinch rolls and generating electrical signals indicating the position of the strip relative to the pinch rolls; and i. a position controller actuated by said electrical signals from the sensor capable of actuating the pinch roll tilt drive to tilt the upper pinch relative to the lower pinch roll and automatically steer the strip passing through the pinch rolls.

Alternatively, a method of producing thin cast strip by continuous casting is provided comprising the steps of:

a. assembling a thin strip caster having a pair of casting rolls having a nip there between;

b. assembling a metal delivery system capable of forming a casting pool between the cast rolls above the nip with side dams adjacent the ends of the nip to confine said casting pool;

c. assembling upper and lower pinch rolls, each having a diameter between 300 and 1500 mm, forming a pair of pinch rolls positioned laterally adjacent each other to form a nip between them through which metal strip formed by the caster can pass, where said upper and lower pinch rolls are positioned one above the other with the axes of the pinch rolls offset between 10 and 130 mm in the direction of travel of strip through the pinch rolls, and with the upper pinch roll offset downstream of the direction of travel of the strip through the pinch rolls;

d. introducing molten steel between the pair of casting rolls to form a casting pool supported on casting surfaces of the casting rolls confined by said first side dams;

e. counter-rotating the casting rolls to form solidified metal shells on the surfaces of the casting rolls and to cast from the solidified shells thin steel strip through the nip between the casting rolls; and f. counter-rotating the pinch rolls to cause strip cast by the casting rolls to pass through the nip of the pinch rolls; and e. tilting the upper pinch roll relative to lower pinch roll between 0.5 and 5.0 mm, measured at the edge of the strip, using a pinch roll tilt drive to control steering of the strip passing through the pinch rolls.

In the method of producing thin cast strip by continuous casting the pinch roll diameter may be between 500 and 1000 mm, and the offset of the axes of the pinch rolls may be between 30 and 80 mm.

The method of producing thin cast strip by continuous casting may further comprise:

f. positioning a sensor to sense the position of the strip relative to pinch rolls and generating electrical signals indicating the position of the strip relative to the pinch rolls; and g. assembling a position controller actuated by said electrical signals from the sensor to actuate the pinch roll tilt drive to tilt the upper pinch roll relative to the lower pinch roll and automatically steer the strip passing through the pinch rolls.

Alternatively, a method of producing thin cast strip by continuous casting is provided comprising the steps of:

a. assembling a thin strip caster having a pair of casting rolls having a nip there between;

b. assembling a metal delivery system capable of forming a casting pool between the cast rolls above the nip with side dams adjacent the ends of the nip to confine said casting pool;

c. assembling upper and lower pinch rolls forming a pair of pinch rolls positioned laterally adjacent each other to form a nip between them through which metal strip formed by the caster can pass, where said upper and lower pinch rolls are positioned one above the other with the axes of the pinch rolls offset in the direction of travel of strip through the pinch rolls, and with the upper pinch roll offset downstream of the direction of travel of the strip through the pinch rolls, and assembling a pinch roll tilt drive to tilt the upper pinch roll relative to lower pinch roll to control steering of the strip passing through the pinch rolls selected such that:

$$(R_{upper\ min}+h_{min}+R_{lower\ min}-|\mathrm{Tilt}_{os\text{-}ds}|)/(R_{upper\ max}+h_{max}+R_{lower\ max})>\cos(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness taking into consideration strip profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$\mathrm{Tilt}_{os\text{-}ds}$ is tilt of the axis of the upper pinch roll relative to the lower pinch roll measured vertically between edges of the strip; and $\theta$ is angle from vertical from a line between the axis of the upper and the lower pinch rolls.

d. introducing molten steel between the pair of casting rolls to form a casting pool supported on casting surfaces of the casting rolls confined by said first side dams;

e. counter-rotating the casting rolls to form solidified metal shells on the surfaces of the casting rolls and to cast thin steel strip from through the nip between the casting rolls from said solidified shells; and f. counter-rotating the pinch rolls to cause strip to pass through the nip of the pinch rolls; and g. steering the thin cast strip between the pinch rolls by controlling the tilt of the upper pinch roll relative to the lower pinch roll with the pinch tilt drive.

This method of producing thin cast strip by continuous casting may also further comprise:

h. positioning a sensor to sense the position of the strip relative to pinch rolls and generating electrical signals indicating the position of the strip relative to the pinch rolls; and i. assembling a position controller actuated by said electrical signals from the sensor to actuate the pinch roll tilt drive to tilt the upper pinch roll relative to the lower pinch roll and automatically steer the strip passing through the pinch rolls.

Still further, a method of steering thin cast strip during continuous casting is disclosed comprising the steps of:

a. assembling upper and lower pinch rolls having a diameter between 300 and 1500 mm forming a pair of pinch rolls positioned laterally adjacent each other to form a nip between them through which metal strip formed by the caster can pass, with said upper and lower pinch rolls one above the other with the axes of the pinch rolls offset between 10 and 130 mm in the direction of travel of strip through the pinch rolls, and with the upper pinch roll offset positioned downstream of the direction of travel of the strip through the pinch rolls;

b. counter-rotating the pinch rolls to cause strip to pass through the nip of the pinch rolls; and c. tilting the upper pinch rolls relative to lower pinch roll between 0.5 and 5.0 mm, measured at the edge of the strip, by a pinch roll tilt drive to control steering of the strip passing through the pinch rolls.

In this method of steering thin cast strip during continuous casting, the pinch roll diameter may be between 500 and 1000 mm, and the offset of the axes of the pinch rolls may be between 30 and 80 mm.

The method of steering thin cast strip during continuous casting may also comprise:

d. positioning a sensor to sense the position of the strip relative to pinch rolls; and e. assembling a controller actuated by signals from the sensor to actuate the pinch roll tilt drive to tilt the upper pinch roll relative to the lower pinch roll and automatically steer the strip passing through the pinch rolls.

Alternatively, a method of steering thin cast strip during continuous casting is disclosed comprising the steps of:

a. assembling upper and lower pinch rolls each having a diameter between 300 and 1500 mm forming a pair of pinch rolls positioned laterally adjacent each other to form a nip between them through which metal strip formed by a caster can pass, where said upper and lower pinch rolls are positioned one above the other with the axes of the pinch rolls offset in the direction of travel of strip through the pinch rolls, and with the upper pinch roll offset downstream of the direction of travel of the strip through the pinch rolls, and assembling a pinch roll tilt drive to tilt the upper pinch rolls relative to the lower pinch roll to control steering of the strip passing through the pinch rolls selected such that:

$$(R_{upper\ min}+h_{min}+R_{lower\ min}-|\mathrm{Tilt}_{os\text{-}ds}|)/(R_{upper\ max}+h_{max}+R_{lower\ max})>\cos(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness taking into consideration strip profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$\mathrm{Tilt}_{os\text{-}ds}$ is tilt of the axis of the upper pinch roll relative to the lower pinch roll measured vertically between edges of the strip; and $\theta$ is angle from vertical from a line between the axis of the upper and the lower pinch rolls.

b. counter-rotating the pinch rolls to cause strip to pass through the nip of the pinch rolls; and c. steering the thin cast strip between the pinch rolls by controlling the tilt of the upper pinch roll relative to the lower pinch roll with the pinch roll tilt drive.

Other details, objects and advantages of the invention will be apparent from the following description of particularly presently contemplated embodiments of the invention proceeds.

BRIEF DESCRIPTION OF THE DRAWINGS

The operation of an illustrative twin roll casting plant in accordance with the present invention is described with reference to the accompanying drawings, in which.

DESCRIPTION OF THE PREFERRED EMBODIMENTS

Figure 1:
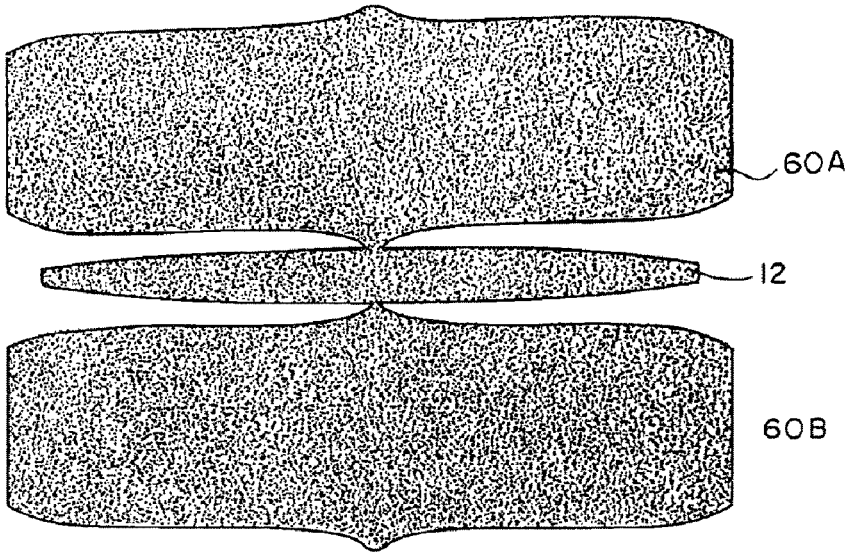
PRIOR ART FIG. 1
FIG. 1 is a schematic illustrating the problem of localized contact experienced with pinch roll steering of thin cast strip in a plant for continuously casting thin cast strip.

The illustrated casting and rolling installation comprises a twin-roll caster denoted generally by 11 which produces thin cast steel strip 12. Thin cast steel strip 12 passes downwardly and then into a transient path across a guide table 13 to a pinch roll stand 14. After exiting the pinch roll stand 14, thin cast strip 12 may optionally pass into and through hot rolling mill 15 comprised of back up rolls 16 and upper and lower work rolls 16A and 16B, where the thickness of the strip may be reduced. The strip 12, upon exiting the rolling mill 16, passes onto a run out table 17, where it may be forced cooled by water jets 18, and then through pinch roll stand 20, comprising a pair of pinch rolls 20A and 20B, and then to a coiler 19, where the strip 12 is coiled, for example, into 20 ton coils.

Twin-roll caster 11 comprises a pair of laterally positioned casting rolls 22 having casting surfaces 22A, and forming a nip 27 between them. Molten metal is supplied during a casting campaign from a ladle (not shown) to a tundish 23, through a refractory shroud 24 to a removable tundish 25 (also called distributor vessel or transition piece), and then through a metal delivery nozzle 26 (also called a core nozzle) between the casting rolls 22 above the nip 27. Removable tundish 25 is fitted with a lid 29. The tundish 23 is fitted with a stopper rod and a slide gate valve (not shown) to selectively open and close the outlet from shroud 24, to effectively control the flow of molten metal from the tundish 23 to the caster. The molten metal flows from removable tundish 25 through an outlet and usually to and through delivery nozzle 26.

Molten metal thus delivered to the casting rolls 22 forms a casting pool 30 above nip 27 supported by casting roll surfaces 22A. This casting pool is confined at the ends of the rolls by a pair of side dams or plates 28, which are applied to the ends of the rolls by a pair of thrusters (not shown) comprising hydraulic cylinder units connected to the side dams. The upper surface of the casting pool 30 (generally referred to as the "meniscus" level) may rise above the lower end of the delivery nozzle 26 so that the lower end of the deliver nozzle is immersed within the casting pool.

Casting rolls 22 are internally water cooled by coolant supply (not shown) and driven in counter rotational direction by drives (not shown) so that shells solidify on the moving casting roll surfaces 22A and are brought together at the nip 27 to produce the thin cast strip 12, which is delivered downwardly from the nip between the casting rolls.

Below the twin roll caster 11, the cast steel strip 12 passes within sealed enclosure 10 to the guide table 13, which guides the strip to pinch roll stand 14, through which it exits sealed enclosure 10. The seal of the enclosure 10 may not be complete, but is appropriate to allow control of the atmosphere within the enclosure and of access of oxygen to the cast strip within the enclosure as hereinafter described. After exiting the sealed enclosure 10, the strip 12 may pass through further sealed enclosures (not shown) after the pinch roll stand 14.

Figure 3:
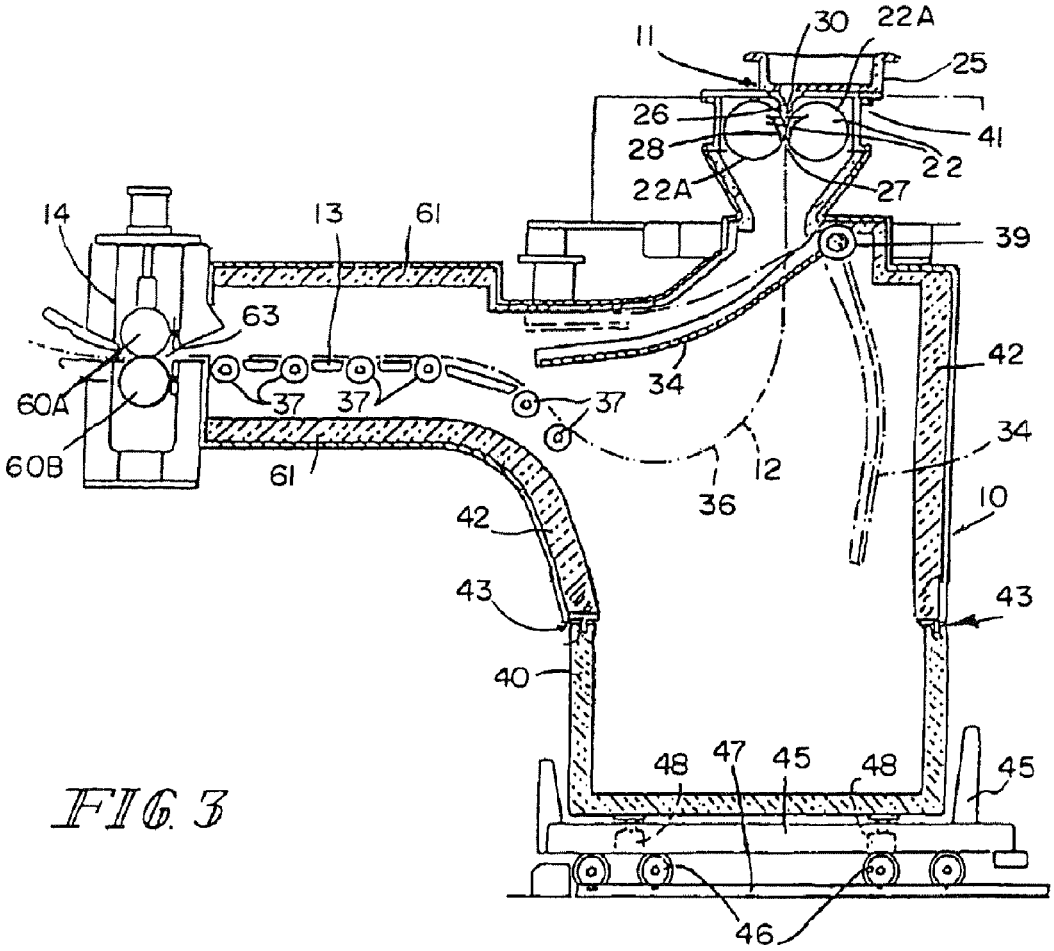
FIG. 3 is an enlarged cut-away side view of the caster of the thin strip casting plant of FIG. 2.

Enclosure 10 is formed by a number of separate wall sections which fit together at various seal connections to form a continuous enclosure wall. As shown in FIG. 3, these sections comprise a first wall section 41 at the twin roll caster 11 to enclose the casting rolls 22, and a wall enclosure 42 extending downwardly beneath first wall section 41 to form an opening that is in sealing engagement with the upper edges of a scrap box receptacle 40. A seal 43 between the scrap box receptacle 40 and the enclosure wall 42 may be formed by a knife and sand seal around the opening in enclosure wall 42, which can be established and broken by vertical movement of the scrap box receptacle 40 relative to enclosure wall 42. More particularly, the upper edge of the scrap box receptacle 40 may be formed with an upwardly facing channel which is filled with sand and which receives a knife flange depending downwardly around the opening in enclosure wall 42. Seal 43 is formed by raising the scrap box receptacle 40 to cause the knife flange to penetrate the sand in the channel to establish the seal. This seal 43 may be broken by lowering the scrap box receptacle 40 from its operative position, preparatory to movement away from the caster to a scrap discharge position (not shown).

Scrap box receptacle 40 is mounted on a carriage 45 fitted with wheels 46 which run on rails 47, whereby the scrap box receptacle 40 can be moved to the scrap discharge position. Carriage 45 is fitted with a set of powered screw jacks 48 operable to lift the scrap box receptacle 40 from a lowered position, where it is spaced from the enclosure wall 42, to a raised position where the knife flange penetrates the sand to form seal 43 between the two.

Figure 4:
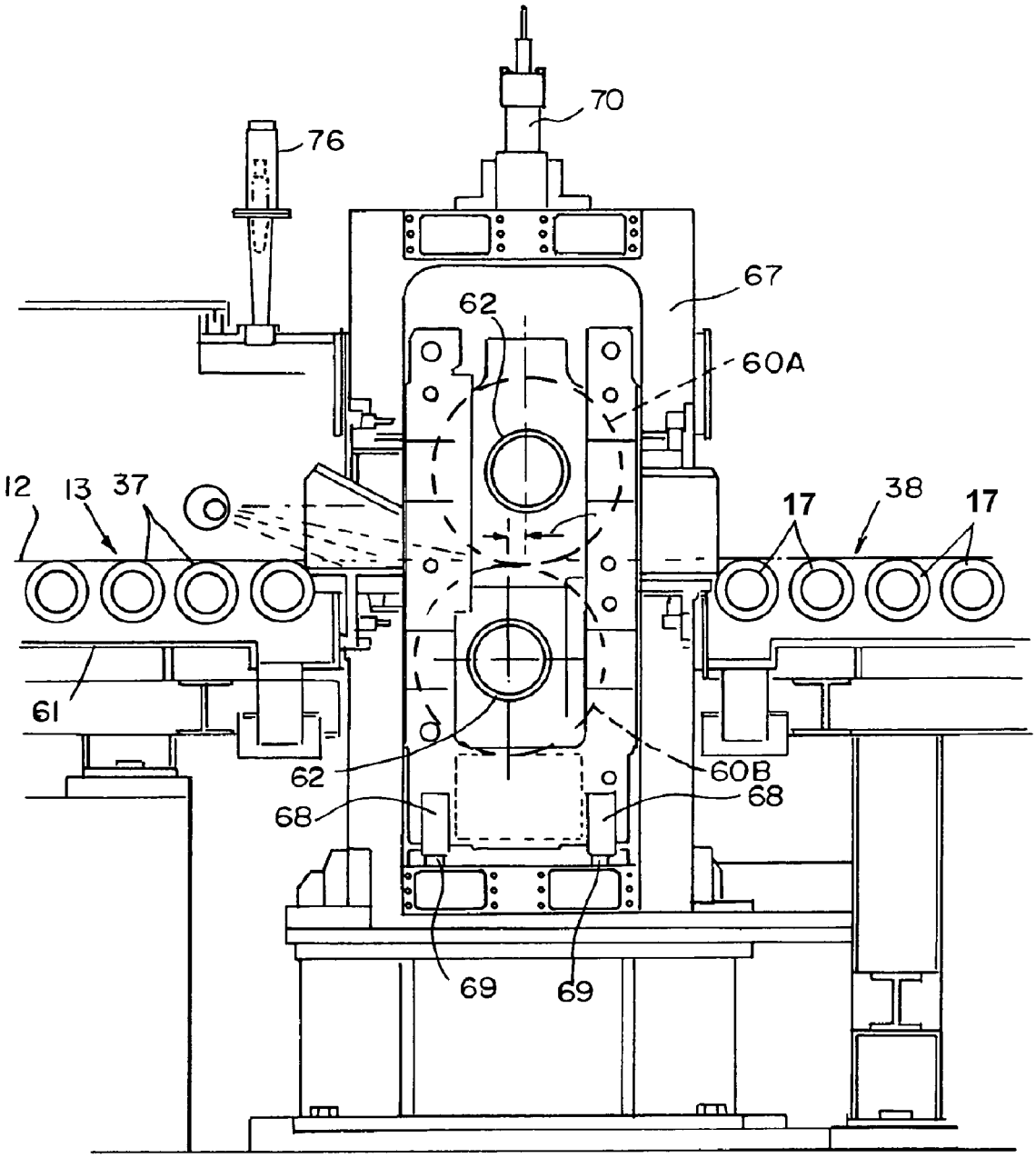
FIG. 4 is an end view of the pinch rolls of the thin strip casting plant of FIG. 2.

Sealed enclosure 10 further may have a third wall section disposed 61 about the guide table 13 and connected to the frame 67 of pinch roll stand 14, which supports a pair of pinch rolls 60A and 60B in chocks 62 as shown in FIG. 4. The third wall section disposed 61 of enclosure 10 is sealed by sliding seals 63.

Most of the enclosure wall sections 41, 42 and 61 may be lined with fire brick. Also, scrap box receptacle 40 may be lined either with fire brick or with a castable refractory lining.

In this way, the complete enclosure 10 is sealed prior to a casting operation, thereby limiting access of oxygen to thin cast strip 12, as the strip passes from the casting rolls 22 to the pinch roll stand 14. Initially the strip 12 can take up the oxygen from the atmosphere in enclosure 10 by forming heavy scale on an initial section of the strip. However, the sealing enclosure 10 limits ingress of oxygen into the enclosure atmosphere from the surrounding atmosphere to limit the amount of oxygen that could be taken up by the strip 12. Thus, after an initial start-up period, the oxygen content in the atmosphere of enclosure 10 will remain depleted, so limiting the availability of oxygen for oxidation of the strip 12. In this way, the formation of scale is controlled without the need to continuously feed a reducing or non-oxidizing gas into the enclosure 10.

Of course, a reducing or non-oxidizing gas may be fed through the walls of enclosure 10. However, in order to avoid the heavy scaling during the start-up period, the enclosure 10 can be purged immediately prior to the commencement of casting so as to reduce the initial oxygen level within enclosure 10, thereby reducing the time period for the oxygen level to stabilize in the enclosure atmosphere as a result of the interaction of the oxygen in oxidizing the strip passing through it. Thus, illustratively, the enclosure 10 may conveniently be purged with, for example, nitrogen gas. It has been found that reduction of the initial oxygen content to levels of between 5% and 10% will limit the scaling of the strip at the exit from the enclosure 10 to about 10 microns to 17 microns even during the initial start-up phase. The oxygen levels may be limited to less than 5%, and even 1% and lower, to further reduce scale formation on the strip 12.

Figure 2:
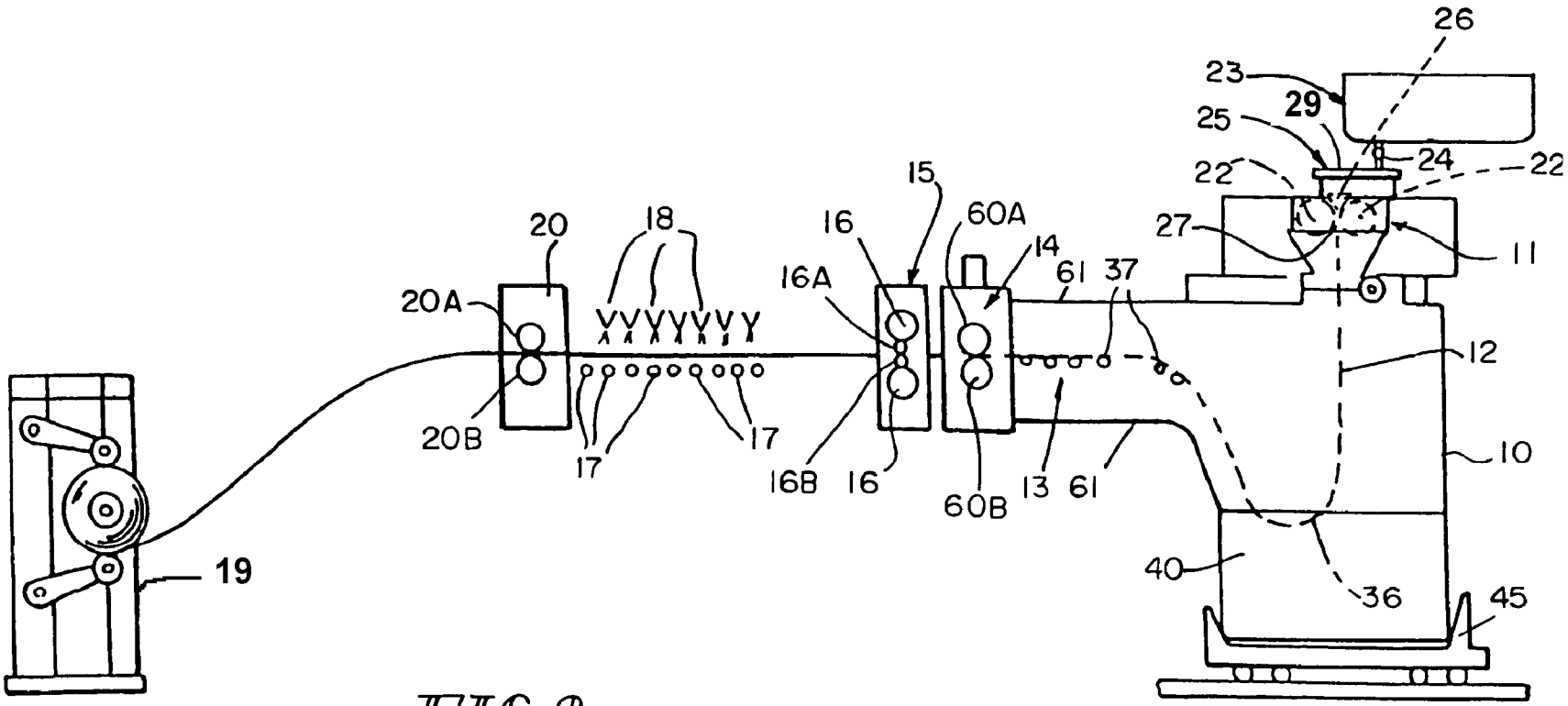
FIG. 2 is a schematic illustrating a thin strip casting plant with a pinch roll apparatus for steering thin cast strip in a plant for continuously casting thin cast strip.

At the start of a casting campaign a short length of imperfect strip is produced as the casting condition stabilize. After continuous casting is established, the casting rolls 22 are moved apart slightly and then brought together, again to cause this leading end of the strip to break away in the manner described in Australian Patent 646,981 and U.S. Pat. No. 5,287,912, to form a clean head end of the following thin cast strip 12. The imperfect material drops into scrap box receptacle 40 located beneath caster 11, and at this time swinging apron 34, which normally hangs downwardly from a pivot 39 to one side of the caster as shown in FIG. 3, is swung across the caster outlet to guide the clean end of thin cast strip 12 onto the guide table 13, where the strip is fed to pinch roll stand 14. Apron 34 is then retracted back to its hanging position as shown in FIG. 3, to allow the strip 12 to hang in a loop 36 beneath the caster as shown in FIGS. 2 and 3 before the strip passes onto the guide table 13. The guide table 13 comprises a series of strip support rolls 37 to support the strip before it passes to the pinch roll stand 14. The rolls 37 are disposed in an array extending from the pinch roll stand 14 backwardly beneath the strip 12 and curve downwardly to smoothly receive and guide the strip from the loop 36.

The twin-roll caster may be of a kind which is illustrated and described in detail in U.S. Pat. Nos. 5,184,668 and 5,277,243, or U.S. Pat. No. 5,488,988. Reference may be made to these patents for construction details, which are no part of the present invention.

Pinch roll stand 14 comprises an upper pinch roll 60A and a lower pinch roll 60B forming a pair of pinch rolls, and provides reaction to tension applied to the strip 12 by a hot rolling mill 15. Accordingly, the strip 12 is able to hang in the loop 36 as it passes from the casting rolls 22 to the guide table 13 and into the pinch roll stand 14. The pinch rolls 60A and 60B thus provides a tension barrier between the freely hanging loop 36 and tension on the strip 12 in downstream part of the processing line. The pinch rolls 60A and 60B also stabilize the position of the strip on the feed table 38, feeding the strip from the pinch roll stand 14 into hot rolling mill 15. The pinch roll stand 14, as described in more detail below, provides a device to avoid the strong tendency, experienced in the past, for the strip to wander laterally on the guide table 13 to such an extent as to produce distortion in the shape of the strip. As previously experienced, the consequence is generation of waviness and cracks in the strip, and in extreme cases complete disruption of the strip by massive transverse cracking.

Figure 5:
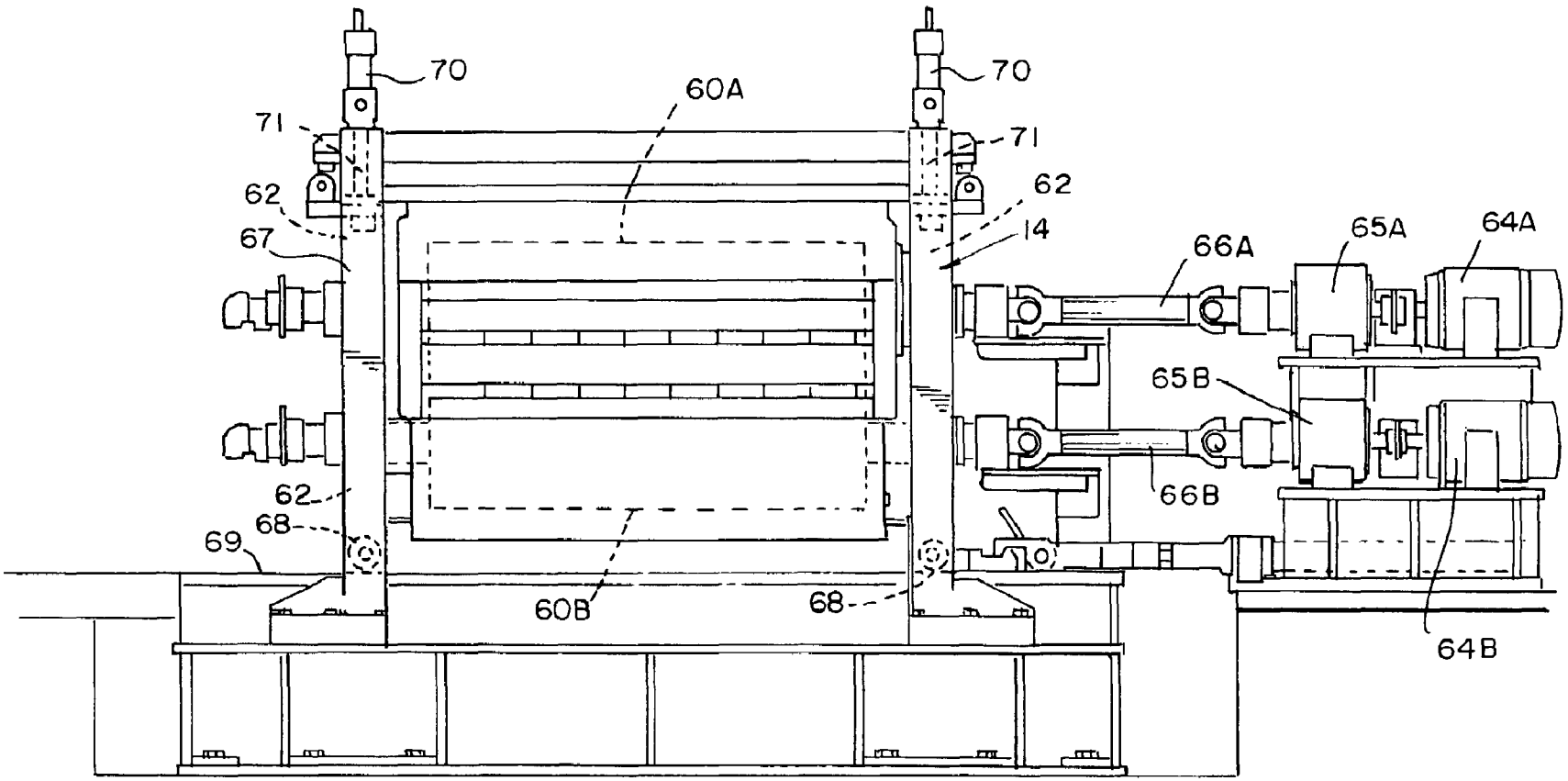
FIG. 5 is a side view of the pinch rolls of thin strip casting plant of FIG. 2.
Figure 6:
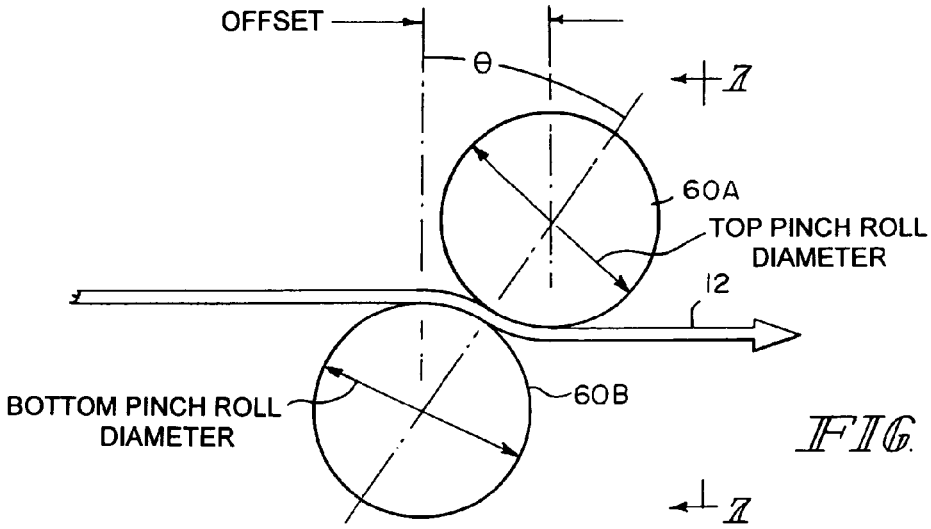
FIG. 6 is an end view illustrating the operation of the pinch rolls of the thin strip casting plant of FIG. 2.

In order to control steering of the strip, pinch rolls 60A and 60B have a diameter between 300 and 1500 mm, and a convex crown shape. The diameter of the pinch rolls 60A and 60B may be between 500 and 1000 mm. Pinch rolls 60A and 60B are offset from each other with their axes of rotation between 10 and 130 mm apart along the direction of travel of the strip, to provide contact between the strip and the rolling surface of the pinch rolls across the width of the strip. The upper pinch roll 60A is offset positioned downstream of the direction of travel of the strip through the pinch rolls as shown in FIGS. 4 and 6. Electric motor drive 64A and 64B shown in FIG. 5 are capable of driving, through gear boxes 65A and 65B and universal couplers 66A and 66B, pinch rolls 60A and 60B, respectively, to counter rotate the pinch rolls and cause strip to pass through the nip of the pinch rolls.

Figure 7:
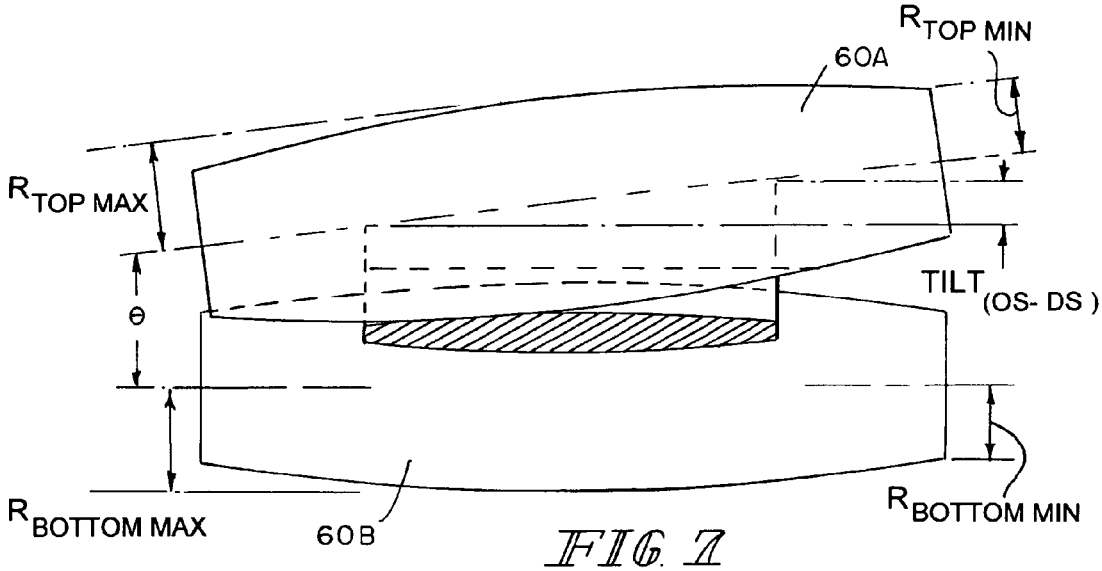
FIG. 7 is a side view illustrating the operation of the pinch rolls of thin strip casting plant of FIG. 2.

The pinch rolls 60A and 60B are assembled in a cassette that rolls into the frame 67 of the pinch roll stand 14 on rollers 68 mounted on rails 69. Pneumatic or hydraulic tilt drive 70 is also disposed at least at one end, and preferably on both ends, of upper pinch roll 60A, and capable of operating to tilt the upper pinch roll 60A relative to the lower pinch roll 60B as shown in FIGS. 5 and 7. Each tilt drive 70 is mounted at the top of frame 67 and connected through cylinder 71 to chocks 62 supporting the ends of upper pinch roll 60A.

The tilt drive or drives 70 are capable of tilting the upper pinch roll 60A relative to the lower pinch roll 60B by a range between 0.5 and 5.0 mm, measured vertically across the strip 12 from one edge to the other. That is, the tilt is measured vertically at the edge of the strip across the strip. Note, if tilt drives 70 are provided at both ends of the upper pinch roll 60A as shown in FIG. 5, and one tilt drive 70 tilts the upper pinch roll up and the other tilt drive 70 tilts the upper pinch roll down, the measured tilt is the addition of the tilts contributed by both tilt drives across the strip from one edge of the strip to the other edge. Also, if tilt drives 70 are provided at each end of pinch roll 60A, the tilt roll drives may independently operable to provide greater agility and speed in varying the tilt of pinch roll 60A relative to pinch roll 60B, to provide more accurate and more responsive steering control for the strip in the thin cast plant with the pinch rolls. In this way, pinch roll 60A can be operated to accurately steer the strip by positive tilting of upper pinch roll 60A relative to lower pinch roll 60B, while providing positive contact between the strip 12 and both pinch rolls 60A and 60B across the strip during the casting campaign. This operation of the pinch rolls 60A and 60B is illustrated in FIGS. 6 and 7.

By introducing an offset between the axes of the upper and lower pinch rolls 60A and 60B, there is an intermesh between the pinch rolls of sufficient magnitude to remove the opportunity for the strip 12 to travel through the nip between the pinch rolls without contacting across the width of the strip as shown in FIG. 6. This intermesh provides a parameter to determine the permissible offset and roll diameter combinations that satisfy the process requirements. From the range of axes offset and pinch roll radius combinations which would satisfy this intermesh requirement the following offset axes and roll radius combination was selected as an example:

| | |
|---|---|
| Axes offset of pinch rolls: | 50 mm |
| Upper pinch roll diameter: | 550 mm-600 mm |
| Lower pinch roll diameter | 550 mm-600 mm |

Figure 9:
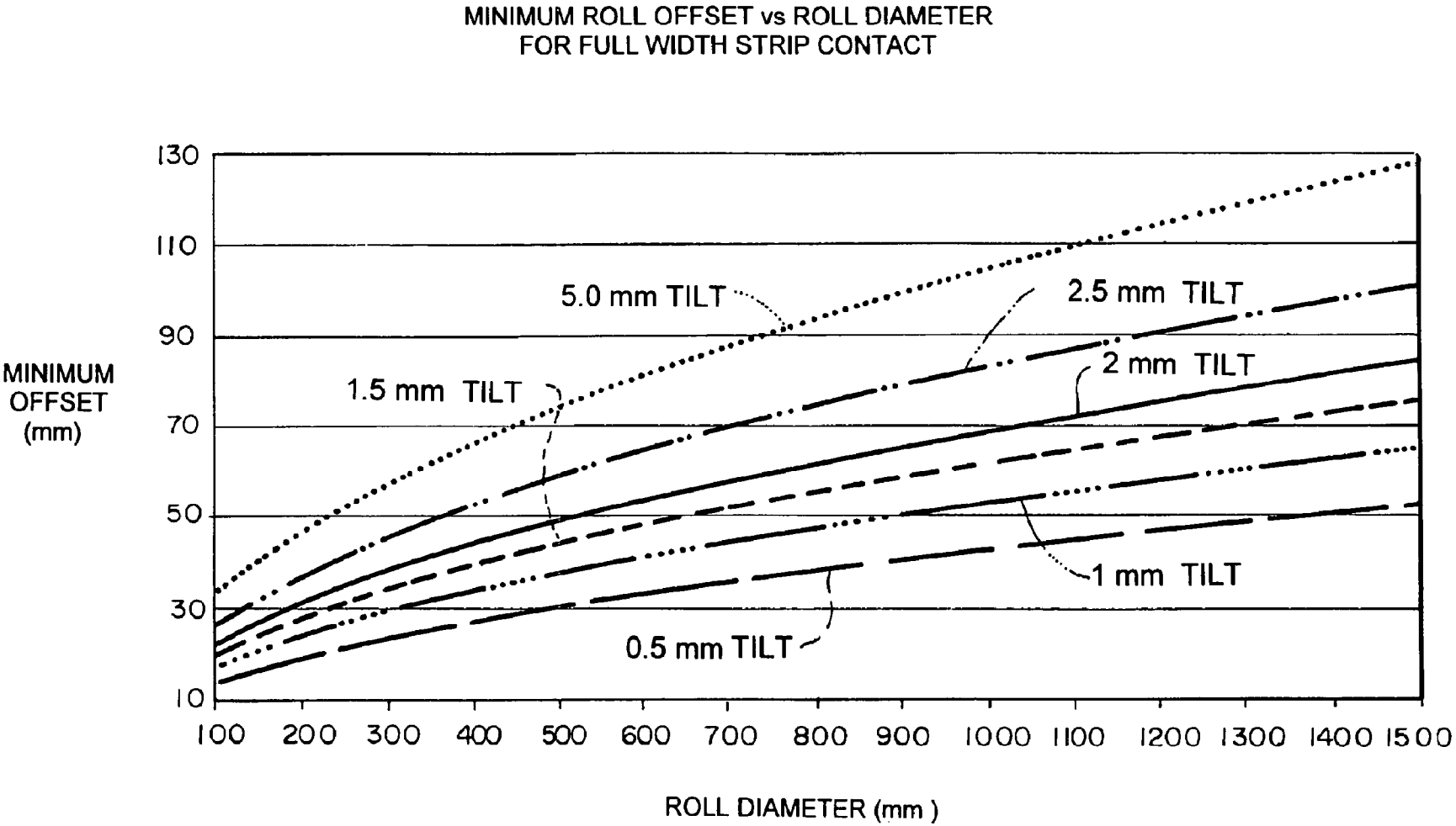
FIG. 9 is a graph showing minimum offset of the pinch rolls of a pair of pinch rolls of thin strip casting plant of FIG. 2.

It should be noted that other combinations offset and roll diameter as shown in FIG. 9 could be selected to provide the desired pinch roll performance.

Additionally, or alternatively, the dimensions of the pinch roll and the pinch roll tilt drive may be selected to comply with the following equation to further provide for strip to pinch roll contact across the strip width:

$$(R_{upper\ min}+h_{min}+R_{lower\ min}-|\mathrm{Tilt}_{os\text{-}ds}|)/(R_{upper\ max}+h_{max}+R_{lower\ max})>(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness taking into consideration profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$\mathrm{Tilt}_{os\text{-}ds}$ is tilt of the axis of the upper pinch roll relative to the lower pinch roll measured vertically between the edges of the strip; and $\theta$ is angle from vertical of the line between the axis of the upper and the lower pinch rolls.

Figure 8:
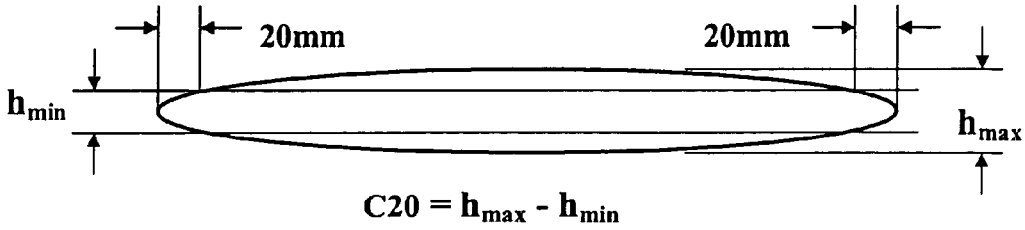
FIG. 8 is a strip profile showing the variables in the equation described hereinafter.

These parameters are shown in relation to the strip 12 in FIG. 8.

To size the pinch rolls using the example data set forth above gives the following parameters:

Pinch roll radius of 322.5 mm.

Pinch roll ground profile (min to max in strip width) of 0.060 mm on radius.

Pinch roll thermal profile assuming full width contact 0.050 mm on radius.

$h_{max}-h_{min}$ (called $C_{20}$) magnitude of 0.180 mm.

Operating a vertical tilt of ±1.5 mm measured across the strip from one strip edge of the strip to the other.

Using these parameters, the minimum roll axes offset to provide full width contact was determined for a range of pinch roll diameters, and limits on the amount of roll tilt within the strip width. The results are provided in FIG. 9. From FIG. 9, it is seen that at the targeted limit for tilting the upper pinch roll (1.5 mm), a minimum of 50 mm axes offset was needed between pinch rolls 60A and 60B at pinch roll diameter near 650 mm.

It should be noted that the introduction of the offset between the rolls creates a steering mechanism which will act in addition to the effect of the differential pressure in the nip between the pinch rolls. This acts by rotating about a pivot point to misalign the upper pinch roll 60A and the incoming strip 12 as shown in FIG. 7. The limit on the tilt of ±1.5 mm within the strip width as described in the calculations above has an effective steering angle of ±0.065 degrees.

The steering by the pinch roll 60A in the plant for casting thin cast strip may be automated by positioning a sensor 76 (shown in FIG. 4) to sense the location of an edge, or some other portions, of the strip relative to pinch rolls adjacent the pinch rolls 60A and 60B, and generate electrical signals indicating the position of the strip relative to the pinch rolls. A controller (not shown) is provided that is actuated by electrical signals from the sensor 76, and sends electrical signals to actuate and control the pinch roll tilt drives 70 to tilt the upper pinch 60A relative to the lower pinch roll 60B and automatically steer the strip as it passes through the pinch rolls.

This steering mechanism will introduce a useful degree of proportional response from the derivative controller with a single integration from steering angle to lateral strip position. The transverse strip velocities associated with this angle range are up to ±1.1 mm/s. As such, the controller will exhibit a higher degree of stability and be able to be tuned to a higher gain, and in turn the stirring of the strip 12 can be controlled accurately and wandering of the strip avoided if not eliminated.

What is claimed is:

1. Pinch roll apparatus comprising:

a. upper and lower pinch rolls forming a pair of pinch rolls each having a diameter between 300-1500 millimeters positioned laterally adjacent each other to form a nip between them through which metal strip can be continuously fed;

b said upper and lower pinch rolls being positioned one above the other with the axes of the pinch rolls preselected to be offset in the direction of travel of strip through the pinch rolls between 10 and 130 mm, and with the upper pinch roll offset positioned downstream of the direction of travel of the strip through the pinch rolls;

c. a rotational drive capable of counter-rotating the pinch rolls to cause strip to pass through the nip of the pinch rolls; and d. a tilt drive capable of tilting the upper pinch roll by a tilt between 0.5 and 5.0 mm, measured at the edge of the strip, relative to the lower pinch roll to control steering of the strip passing through the pinch rolls.

2. The pinch roll apparatus of claim 1 further comprising:

e. a sensor capable of sensing the position of the strip relative to the pinch rolls and generating electrical signals indicating the position of the strip relative to the pinch rolls; and f. a position controller actuated by said electrical signals from the sensor capable of actuating the drive to tilt the upper pinch roll relative to the lower pinch roll and automatically steer the strip passing through the pinch rolls.

3. The pinch roll apparatus of claim 1 where the pinch roll diameter is between 500 and 1000 mm.

4. The pinch roll apparatus of claim 1 where the offset of the axes of the pinch roll is between 30 and 80 mm.

5. Pinch roll apparatus comprising:

a. upper and lower pinch rolls forming a pair of pinch rolls positioned laterally adjacent each other to form a nip between them through which metal strip can be continuously fed;

b. said upper and lower pinch rolls being positioned one above the other with the axes of the pinch rolls preselected to be offset in the direction of travel of strip through the pinch rolls, and with the upper pinch roll offset positioned downstream of the direction of travel of the strip through the pinch rolls;

c. a rotational drive capable of counter-rotating the pinch rolls to cause strip to pass through the nip of the pinch rolls; and d. a tilt drive capable of tilting the upper pinch roll by an angle relative to the lower pinch roll to control steering of the strip passing through the pinch rolls;

selected such that:

$$(R_{upper\ min}+h_{min}+R_{lower\ min}-|\mathrm{Tilt}_{os\text{-}ds}|)/(R_{upper\ max}\ h_{max}+R_{lower\ max})>\cos(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness taking into consideration profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$\mathrm{Tilt}_{os\text{-}ds}$ is tilt of the axis of the upper pinch roll relative to the lower pinch roll measured vertically between the edges of the strip; and θ is angle from vertical of the line between the axis of the upper and the lower pinch rolls.

6. The pinch roll apparatus of claim 5 further comprising:

e. a sensor capable of sensing the position of the strip relative to the pinch rolls and generating electrical signals indicating the position of the strip relative to the pinch rolls; and f. a tilt drive to tilt the upper pinch roll relative to the lower pinch roll and automatically steer the strip passing through the pinch rolls.

7. A thin cast strip plant for producing strip by continuous casting comprising:

a. a thin strip caster having a pair of casting rolls having a nip there between;

b. a metal delivery system capable of forming a casting pool between the casting rolls above the nip with side dams adjacent the ends of the nip to confine said casting pool;

c. a casting roll drive capable of counter-rotating the casting rolls to form metal shells on surfaces of the casting rolls, and cast strip delivered downwardly from the nip between the casting rolls;

d. upper and lower pinch rolls forming a pair of pinch rolls each having a diameter between 300-1500 millimeters positioned laterally adjacent each other to form a nip between them through which metal strip formed by the caster can pass;

e. said upper and lower pinch rolls being positioned one above the other with the axes of the pinch rolls preselected to be offset in the direction of travel of strip through the pinch rolls by between 10 and 130 mm, and with the upper pinch roll offset positioned downstream of the direction of travel of the strip through the pinch rolls;

f. a pinch roll rotational drive capable of counter-rotating the pinch rolls to cause strip to pass through the nip of the pinch rolls; and g. a pinch roll tilt drive capable of tilting the upper pinch roll by a tilt between 0.5 and 5.0 mm, measured at the edge of the strip, relative to the lower pinch roll to control steering of the strip passing through the pinch rolls.

8. The thin cast strip plant for producing strip by continuous casting of claim 7 further comprising:

h. a sensor capable of sensing the position of the strip relative to the pinch rolls and generating electrical signals indicating the position of the strip relative to the pinch rolls; and i. a position controller actuated by said electrical signals from the sensor capable of actuating the pinch roll tilt drive to tilt the upper pinch roll relative to the lower pinch roll and automatically steer the strip passing through the pinch rolls.

9. The thin cast strip plant for producing strip by continuous casting of claim 7 where the pinch roll diameter is between 500 and 1000 mm.

10. The thin cast strip plant for producing strip by continuous casting of claim 7 where the offset of the axes of the pinch roll is between 30 and 80 mm.

11. A thin cast strip plant for producing strip by continuous casting comprising:

a. a thin strip caster having a pair of casting rolls having a nip there between;

b. a metal delivery system capable of forming a casting pool between the casting rolls above the nip with side dams adjacent the ends of the nip to confine said casting pool;

c. a casting roll drive capable of counter-rotating the casting rolls to form metal shells on surfaces of the casting rolls, and to cast strip from the shells delivered downwardly from the nip between the casting rolls;

d. upper and lower pinch rolls forming a pair of pinch rolls positioned laterally adjacent each other to form a nip between them through which metal strip formed by the caster can pass;

e. said upper and lower pinch rolls being positioned one above the other with the axes of the pinch rolls preselected to be offset in the direction of travel of strip through the pinch rolls, and with the upper pinch roll offset positioned downstream of the direction of travel of the strip through the pinch rolls;

f. a pinch roll rotational drive capable of counter-rotating the pinch rolls to cause strip to pass through the nip of the pinch rolls; and g. a pinch roll tilt drive capable of tilting the upper pinch roll relative to the lower pinch roll to control steering of the strip passing through the pinch rolls;

selected such that:

$$(R_{upper\ min}+h_{min}R_{lower\ min}-|\mathrm{Tilt}_{os\text{-}ds}|)/(R_{upper\ max}+h_{max}+R_{lower\ max})>\cos(\theta)$$

where:

$R_{upper\ min}$ is the minimum radius of upper pinch roll taking into account ground profile and thermal expansion of the pinch roll during normal expected operation;

$R_{lower\ min}$ is the minimum radius of lower pinch roll taking into account ground profile and thermal expansion of the pinch roll during normal expected operation;

$R_{upper\ max}$ is the maximum radius of upper pinch roll, including ground profile and thermal expansion;

$R_{lower\ max}$ is the maximum radius of lower pinch roll, including ground profile and thermal expansion;

$h_{max}$ is the maximum strip thickness considering strip profile variations;

$h_{min}$ is the average of the strip thickness, taking into consideration strip profile variations, measured 20 mm in from either edge of the strip, and is $h_{max}$ minus the difference between strip thickness at the crown of the strip and the average strip thickness 20 mm in from the edges of the strip;

$\mathrm{Tilt}_{os\text{-}ds}$ is tilt of the axis of the upper pinch roll relative to the lower pinch roll measured vertically between edges of the strip; and $\theta$ is angle from vertical of a line between the axis of the upper and the lower pinch rolls.

12. The thin cast strip plant for producing strip by continuous casting of claim 11 further comprising:

h. a sensor capable of sensing the position of the strip relative to pinch rolls and generating electrical signals indicating the position of the strip relative to the pinch rolls; and i. a position controller actuated by said electrical signals from the sensor capable of actuating the pinch roll tilt drive to tilt the upper pinch roll relative to the lower pinch roll and automatically steer the strip passing through the pinch rolls.

* * * * *

UNITED STATES PATENT AND TRADEMARK OFFICE

CERTIFICATE OF CORRECTION

PATENT NO. : 7,631,685 B2
APPLICATION NO. : 11/465276
DATED : December 15, 2009
INVENTOR(S) : Jay Jon Ondrovic It is certified that error appears in the above-identified patent and that said Letters Patent is hereby corrected as shown below:

On the Title page,

[*] Notice: Subject to any disclaimer, the term of this patent is extended or adjusted under 35 USC 154(b) by (524) days Delete the phrase "by 524 days" and insert -- by 644 days --

Signed and Sealed this

Thirtieth Day of March, 2010

David J. Kappos

David J. Kappos
*Director of the United States Patent and Trademark Office*